United States Patent [19]

Parker, Jr.

[11] Patent Number: 5,044,626

[45] Date of Patent: Sep. 3, 1991

[54] EXERCISE APPARATUS HAVING ASYMMETRICAL IMPACT CUSHIONS AND METHODS OF EXERCISING SELECTED MUSCLE GROUPS BY DIRECT FORCE APPLICATION

[76] Inventor: Clarence Parker, Jr., 15433 Sorrento, Detroit, Mich. 48227

[21] Appl. No.: 558,702

[22] Filed: Jul. 23, 1990

[51] Int. Cl.[5] ..... A63B 21/00

[52] U.S. Cl. ..... 272/68; 128/24.3; 128/60; 128/67

[58] Field of Search ..... 272/67, 68, 122, 123, 272/124, 127, 93; 128/24.2, 24.3, 56, 57, 60, 61, 62 R, 67; 273/67 R, 67 D, 83

[56] References Cited

U.S. PATENT DOCUMENTS

| | | | |
|---|---|---|---|
| 1,679,174 | 7/1928 | Richards et al. . | |
| 2,022,002 | 11/1935 | Jacks | 272/57 |
| 2,253,758 | 8/1941 | Bulloch | 272/57 |
| 2,319,109 | 5/1943 | Bulloch | 272/57 |
| 3,336,029 | 8/1967 | London | 273/67 |
| 3,638,939 | 2/1972 | Langley | 272/127 |
| 4,079,936 | 3/1978 | Schachter | 273/67 R |
| 4,257,589 | 3/1981 | Outlaw | 272/93 |
| 4,328,966 | 5/1982 | Miyamoto | 273/67 R X |
| 4,466,610 | 8/1984 | Israel | 272/93 |
| 4,541,322 | 9/1985 | Calato | 273/67 X |
| 4,712,792 | 12/1987 | Rogall | 272/93 |
| 4,745,909 | 5/1988 | Pelton | 128/62 R X |
| 4,807,603 | 2/1989 | Yasui | 272/67 X |
| 4,836,541 | 6/1989 | Henley | 272/124 |

*Primary Examiner*—Richard J. Apley
*Assistant Examiner*—L. Thomas
*Attorney, Agent, or Firm*—Brooks & Kushman

[57] ABSTRACT

An exercise apparatus (10) having a rod (16) including a cylindrical head cushion (14) at one end and an annular heel cushion (12) at a second end with a handle (18) defined between the head and heel cushions. The method of the present invention comprises using the exercise apparatus (10) to increase circulation, muscle tone and skin toughness in a selected muscle group by repeated application of force through the exercise apparatus (10). According to one approach, the exercise apparatus (10) is rolled over a muscle group with a reciprocal rolling motion wherein the handle portion (16) contacts the muscle group while the head cushion (14) and heel cushion (12) of the apparatus (10) are journaled in a user's hand. Another approach is to grasp the apparatus )10) at the handle portion ( 16), and impart chopping blows to a selected muscle group. Another approach is to impart upward, glancing blows of the head cushion (14) of the apparatus (10) against a selected muscle group with a circular motion. In a final approach, the heel cushion (12) of the apparatus (10) may be used to impart localized pressure and friction by applying a twisting movement to a selected muscle group.

13 Claims, 2 Drawing Sheets

EXERCISE APPARATUS HAVING ASYMMETRICAL IMPACT CUSHIONS AND METHODS OF EXERCISING SELECTED MUSCLE GROUPS BY DIRECT FORCE APPLICATION

TECHNICAL FIELD

The present invention relates to a hand manipulated exercise apparatus which is adapted to impart localized force to selected muscle groups.

BACKGROUND ART

Exercise devices are well-known for body building and conditioning. Athletes in many sports exercise to improve their body conditioning in preparation for their chosen sport. Some sports require special conditioning to toughen muscles against impact and to strengthen selective muscle groups. For example, boxers, hockey players, football players and others must become conditioned to withstand contact to various parts of their body.

Conventional exercise apparatus tend to be bulky and heavy such as bar bells, universal gyms and the like. Normally, muscles are exercised by working the muscle groups isometrically or kinetically.

Exercising devices have been developed to strengthen various portions of the body by impact conditioning but such devices suffer from certain drawbacks and problems.

In particular, U.S. Pat. No. 1,679,174 to Richards, et al. discloses a body punch resistance developer in which a padded block 7 is connected to a spring arm 4 that is moved by operating arms 11 to cause a padded block to strike the torso of a person. The device is intended to be used by boxers to increase resistance of the torso muscles to blows. The device is mounted on the floor, and is not portable or useful for exercising muscle groups other than torso muscles.

U.S. Pat. No. 2,253,758 to Bulloch discloses an exercising device which is designed to be installed on a wall. The exercising device includes a plate 10 which extends outwardly from the wall. A cushion is preferably provided between the plate and a supporting bar. The user stands a short distance from the plate, and then falls against the plate contacting the plate with his abdomen. This device is again not portable and intended for strengthening of only the abdominal muscles of a user. U.S. Pat. No. 2,319,109 to Bulloch discloses an improvement of the prior Bulloch device including a spring steel element to provide additional resiliency.

U.S. Pat. No. 4,257,589 to Outlaw discloses another abdominal exercise device wherein a bowling ball 12 is hung from an overhead support. The ball is suspended at the height of a user's abdomen, and then swung repeatedly in an arcuate path to strike abdominal muscles.

Other exercise devices that have been developed for various purposes include a gymnastic device disclosed in U.S. Pat. No. 4,712,792 to Rogall. The Rogall device includes opposite equally sized thickened end portions formed of a rubber or soft foam material that can be used for rhythmic exercises and play. The device is not intended to be used for muscle strengthening or impact conditioning.

U.S. Pat. No. 3,336,029 to London discloses a boxing stick comprising a rigid bar having two ends with equal sized padded head 16 on opposite ends. The boxing stick is intended to be used for training in hand-to-hand combat, and is not intended to be used for muscle toning by self-inflicted blows.

U.S. Pat. No. 2,022,002 to Jacks, discloses an exercise device including a spring element which is intended to be compressed for quasi-isometric exercise. The device includes opposite padded ends which are engaged by a user to compress the spring interconnecting the two opposite ends.

U.S. Pat. No. 4,466,610 to Israel discloses a baton-like club adapted for isometric and aerobic exercises. There is no disclosure or suggestion in the patent that the device be used to increase the user's muscle resistance to repeated blows or any similar method.

None of the above prior art devices disclose or suggest the use of an impact or direct force application type exercise device useful in a variety of force imparting motions to condition selected muscle groups. The prior art abdominal exercisers are somewhat hazardous in that first time users may initially use excessive force and cause harm to themselves. Such devices also suffer from the fact that they are normally installed as fixtures and are not portable. Several of the prior art exercising devices include moving parts which may require some maintenance or calibration for proper use. All of the above devices are useful only to exercise a limited number of muscle groups and are not intended for overall body conditioning. Another problem faced by the prior art devices is difficulty in adapting the devices to different training levels.

It is an object of the present invention to provide a simple and effective exercising apparatus which is useful to condition a wide variety of muscle groups by imparting different types of force directly to the selected muscle group. Glancing blows, twisting forces, impact forces and rolling forces may be imparted with the exercise apparatus of the present invention.

It is another object of the present invention to provide a series of methods of exercising which maximize the versatility of the exercise device of the present invention.

The above problems are solved by the exercise apparatus of the present invention, and the method of using the exercise apparatus. Other objects and advantages of the invention are summarized below and described with reference to the drawings.

DISCLOSURE OF INVENTION

The present invention relates to an exercise apparatus which is adapted to apply forces to selected muscle groups for the purpose of increasing circulation, muscle tone and skin toughness of the muscle groups. The exercise apparatus comprises an elongated rod having an annular heel cushion applied to one end of the rod. A cylindrical head cushion is affixed to the other end of the rod. The head cushion is longer than the heel cushion, preferably at least three times longer than the heel, so that different concentrations of force can be developed by the use of either the heel or the head cushion due to the asymetrical configuration of the apparatus. A handle portion is defined between the head cushion and the heel cushion for gripping the apparatus, and may also be used to contact muscle groups for conditioning. The heel cushion and head cushion are of sufficient thickness to prevent bruising the selected muscle groups during use.

According to another aspect of the invention, a method of exercising is provided using an elongated exercise apparatus having a cylindrical head cushion affixed to one end, and an annular heel cushion affixed to a second end. The exercise apparatus includes a handle being defined between the head and the heel cushion. One method of using the exercise apparatus includes the steps of grasping the exercise apparatus with a user's hand at the handle with the heel closes to the wrist, and the head at the distal end of the apparatus relative to the user's hand. The exercise apparatus is then rotated in a circular motion. While rotating, the exercise apparatus is caused to strike glancing blows with the apparatus upon a selected muscle group which is to be strengthened or conditioned. The striking action continues until the desired strengthening and toughening has been achieved without causing painful bruises. Glancing blows are preferably applied on the upstroke of the circular motion. It is also preferred to use two of said exercise apparatus, one in each hand, with the rotating and striking steps being simultaneously and alternately performed by the user.

According to another method of exercising using the exercise apparatus, rolling pressure is applied to muscles directly to strengthen and toughen them. The rolling pressure is applied by grasping the heel and head portions of the apparatus with the user's hands and rolling the handle portion across the selected muscle group while applying pressure to the muscle group with both hands. Rolling pressure is believed to improve muscle tear resistance.

According to another aspect or method of the present invention, pressure is applied to muscle groups by placing the heel of the exercise apparatus against a muscle group and applying pressure to the head end of the apparatus. While pressure is applied, the apparatus is twisted to create friction and heat on a localized circular portion of a selected muscle group.

Another method of using the above-described exercise apparatus is to apply direct impact blows to a selected muscle group to strengthen and toughen them against impact forces. According to this method, the exercise apparatus is grasped at the handle and the head of the apparatus is then moved with a chopping motion directly against a selected muscle group in a generally perpendicular direction to the surface of the muscle group.

Other uses of the exercise apparatus of the present invention, and other methods of employing the exercise apparatus are expected to be developed as a user becomes more familiar with the exercise apparatus and specifically described methods.

These and other advantages and objects of the present invention are described in detail in the following detailed description in view of the attached drawings.

MODE(S) FOR CARRYING OUT THE INVENTION

Figure 1:
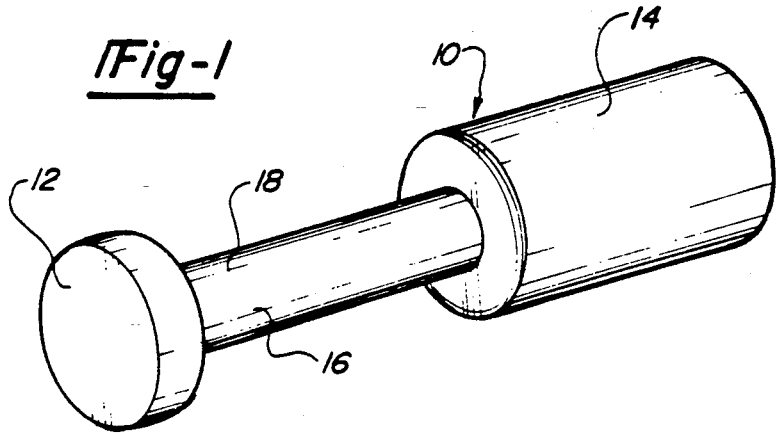
FIG. 1 is a perspective view of the exercise apparatus of the present invention.
Figure 2:
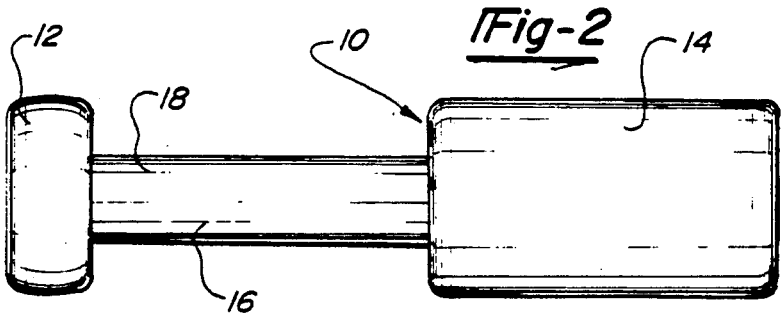
FIG. 2 is a side-elevational view of the exercise apparatus of the present invention.

Referring now to FIGS. 1 and 2, the exercise apparatus of the present invention is illustrated. The exercise apparatus 10 includes a heel cushion 12 and a head cushion 14 on opposite ends of a rod 16. A handle 18 is defined as that portion of the rod 16 between the heel cushion 12 and the head cushion 14.

The heel and head cushions 12 and 14 are preferably formed of padding material and covered by either a leather or vinyl skin. Alternatively, the heel and head cushion may be formed of a molded elastomeric material which is affixed to the rod 16.

The heel cushion 12 is shorter in length than the head cushion 14 to add versatility to the exercise apparatus. The head cushion 14 is larger than the heel cushion 12, and presents a broader contact area so that force may be spread over a wide area. In contrast, the heel cushion has a narrower aspect allowing for focusing force on a smaller muscle group. The asymmetrical relationship of the heel cushion 12 to the head cushion 14 results in the handle 18 being offset toward the heel cushion 12, and provides an asymmetrical device which allows for a variety of force application levels. The heel cushion is preferably between one and two inches long, and has a diameter of from one to three inches. The head cushion is preferably at least three times as long as the heel making it from three to six inches in length, and has a diameter essentially equal to the diameter of the heel.

The rod 16 is preferably a hollow tubular member formed of plastic, or most preferably elastomeric material covered plastic. The rod could also be a solid wood member. The length of the rod is preferably between about 8 and 16 inches. The rod 16 could also be formed as a solid wooden or metal member. The diameter of the rod is preferably approximately one inch. The diameter of the rod may range from about 0.5 inch to two inches.

Figure 3:
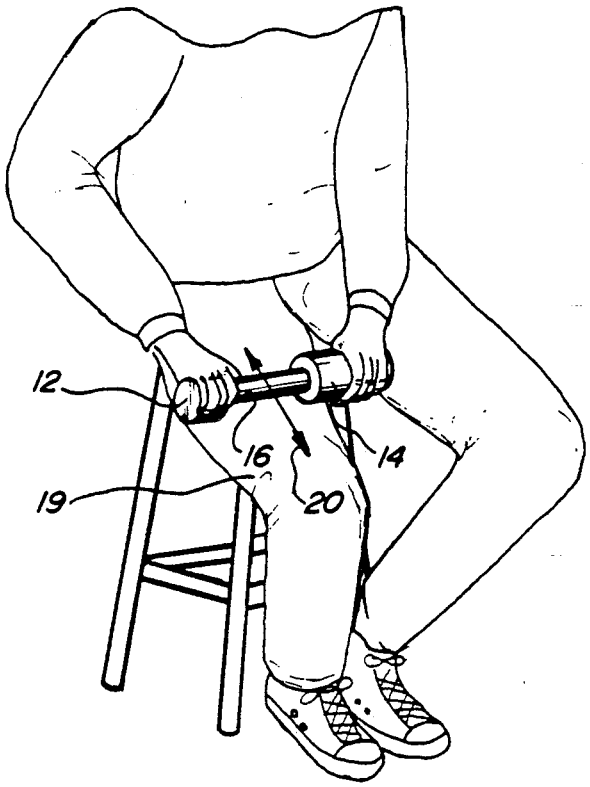
FIG. 3 is a perspective view showing the exercise apparatus being used for a rolling exercise.

Referring now to FIG. 3, the exercise apparatus 10 of the present invention is shown in a rolling exercise method wherein the heel cushion 12 is grasped by the user's right hand while the head cushion 14 is grasped by the user's left hand. The handle 18 is rolled against the top of the user's thigh muscle 19 in a reciprocal rolling motion. Pressure is applied by the user's hands to the heel and head cushions 12 and 14. The rolling motion flattens the selected muscle group and applies non-impacting pressure to the muscle group which naturally resists the pressure and builds strength in the muscle group. This exercise could be used for the following muscle groups:

| | |
|---|---|
| deltoid | gracilis |
| pectoralis major | vastus medialis |
| latissimus dorsi | tibialis anterior |
| gluteus medius | gastrocnemius |
| sartorius | soleus |
| adductor longus | abdominal muscles |
| rectus | |

It is possible that other muscles could be exercised by the above technique. This method also has the advantage of exercising both hands as pressure is applied to the head and heel cushions.

Figure 4:
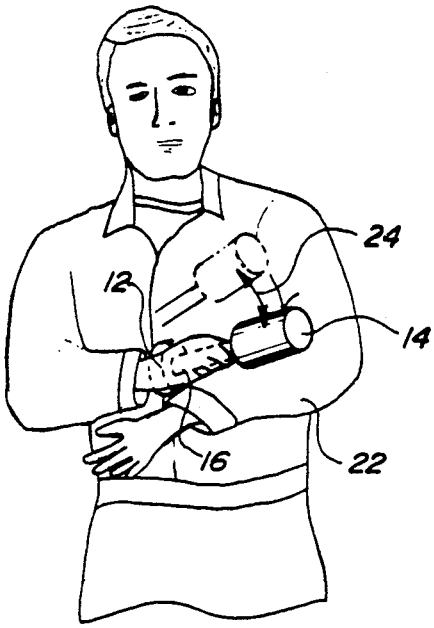
FIG. 4 is a perspective view of the exercise apparatus showing the exercise apparatus being used to impart impact blows.

Referring now to FIG. 4, another method of exercising with the exercise apparatus 10 of the present invention is shown which is referred to as the impact method. The impact method is performed by grasping the exercise apparatus 10 at the handle 18 with one hand and striking a selected muscle group. The muscle group being contacted as shown in FIG. 4 is the brachioradialis. The muscle group is repeatedly struck by the head cushion 14 which imparts a blow over a fairly broad region of the muscle group. Alternatively, the exercise apparatus 10 could be held so that the heel cushion 12 is used to contact a narrow portion of a muscle group.

The impact method rapidly strengthens muscle groups and provides for build-up in resistance to impacts by the muscle group. The natural progressive strengthening of the muscle group occurs as the muscle group tenses to resist the blow. The muscle group rapidly repairs any minor stress caused by the impact at controlled levels, and rebuilds to a stronger level of muscle tone.

Figure 5:
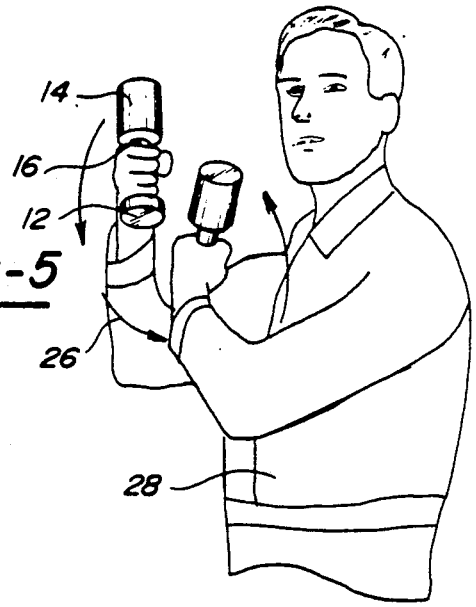
FIG. 5 is a perspective view showing the exercise apparatus being used with a circular motion to impart glancing blows to a selected muscle group.

Referring now to FIG. 5, another method of using the apparatus is shown. In this FIGURE, the user grasps an apparatus 10 in each hand and rotates it in a circular motion as indicated by arrows 26 thereby striking glancing blows off of the abdominal region. This method can also be utilized using only one apparatus 10, however, the use of two hands doubles the efficiency of the method. This method differs from the method illustrated in FIG. 4 in that the blows are applied at a glancing angle to the abdominal region as opposed to the direct force applied in the direct blow method. The blows in the present method are delivered in an upward direction which may serve to counteract the effect of gravity on the muscles. In addition, the approximate 45 degree angle of force imparts stretching stresses to the muscle in addition to direct impact stresses.

Figure 6:
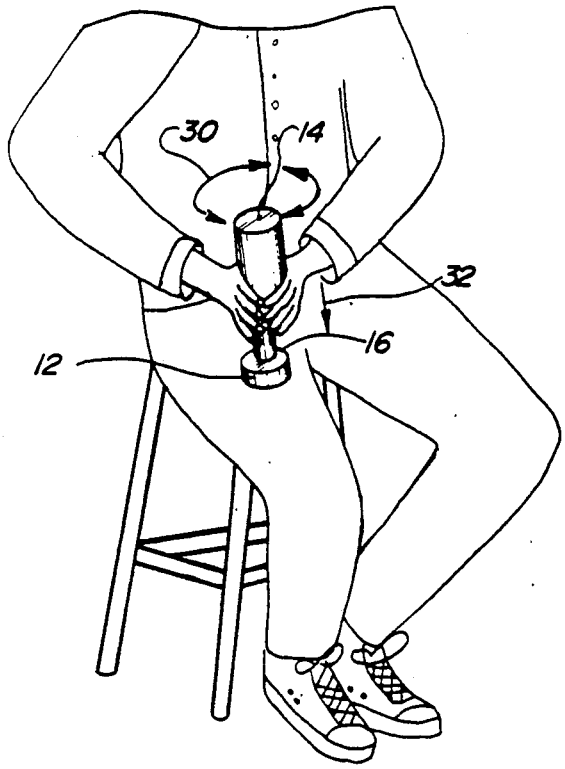
FIG. 6 is a perspective view showing the exercise apparatus being used in a method wherein a twisting pressure is applied to a selected muscle group.

Referring now to FIG. 6, a method is shown whereby the user imparts pressure and heat from friction to a muscle group. In this method, the end of the heel cushion 12 is pressed against the muscle group and the exercise apparatus 10 is grasped in both hands in the region of the handle 18 and head cushion 14. While applying downward pressure, the user also rotates the exercise apparatus 10 so as to create friction directly on a small area on the muscle. The heat generated by the friction increases the circulation to the muscle. The increased circulation results in improved nourishment to the muscle, and contributes to the build-up of muscle fiber. The downward applied pressure imparted to the muscle tends to flatten out and spread the muscle. The muscle reacts in opposition to this pressure thereby creating increased muscle mass and thickness in the localized zone.

The methods as illustrated in the above FIGURES are meant to continue to a point before bruising has occurred to the muscle. In this way, stresses are applied in a controlled manner allowing the muscle to react and slowly build-up its resistance to blows. The muscle groups that may be exercised using the methods in FIGS. 4 through 6 are only limited by the flexibility and dexterity of the user. Some of the more important muscle groups that may be exercised include:

| | |
|---|---|
| trapezius | gluteus medius |
| deltoid | sartorius |
| pectoralis major | adductor longus |
| latissimus dorsi | rectus |
| triceps | gracilis |

-continued

| | |
|---|---|
| biceps | tibialis anterior |
| brachioradialis | gastrocnemius |

It is also anticipated that the exercise apparatus 10 may be used as a manual dexterity enhancer wherein the exercise apparatus 10 is twirled between the thumb and forefinger. In this method, the user's thumb guides the exercise apparatus 10 about the indexed finger which functions as the axis of rotation. This method of whirling strengthens and tones the adductor policis muscles.

The apparatus of the present invention has been described with reference to a preferred embodiment and is used in several methods. It is to be understood as being exemplary. Various changes and modifications are possible to both the apparatus and the methods described above within the spirit and scope of the present invention. The scope of the present invention should be determined by reference to the following claims.

I claim:

1. An exercise apparatus adapted to provide glancing blows, direct impact rolling pressure and twisting pressure to selected muscle groups for the purpose of increasing circulation, muscle tone and skin and muscle toughness within selected muscle groups comprising:

an elongated rod;

an annular heel cushion affixed to one end of said rod, said annular heel cushion having a length of one to two inches and a diameter of one to three inches;

a cylindrical head cushion affixed at the opposite end of said rod from the annular heel cushion, said cylindrical head cushion having a longitudinal dimension that is longer than that of the heel cushion;

a handle portion being defined on said rod between said head and heel cushions; and said heel cushion and said head cushion having sufficient padding to prevent bruising of the selected muscle group.

2. An exercise apparatus adapted to provide glancing blows, direct impact rolling pressure and twisting pressure to selected muscle groups for the purpose of increasing circulation, muscle tone and skin and muscle toughness within selected muscle groups comprising:

an elongated rod;

an annular heel cushion affixed to one end of said rod;

a cylindrical head cushion affixed at the opposite end of said rod from the annular heel cushion, said cylindrical head cushion having a diameter equal to the diameter of the heel cushion;

a handle portion being defined on said rod between said head and heel cushions; and said heel cushion and said head cushion having sufficient padding to prevent bruising of the selected muscle group.

3. A method of exercising using an elongated exercise apparatus having a cylindrical head cushion affixed to one end, and an annular heel cushion affixed to a second end with a handle being defined between the head and heel cushion, said method comprising:

grasping said exercise apparatus with a user's hand at the handle with the heel closest to the wrist and head at the distal end of the apparatus from the user's hand;

rotating said exercise apparatus in a circular motion;

striking glancing blows with the apparatus upon a selected muscle group which is to be strengthened; and continuing striking glancing blows until the desired strengthening and toughening is achieved without bruising.

4. The method of claim 3 wherein the muscle group is selected from the group consisting of:

| | |
|---|---|
| trapezius | gluteus medius |
| deltoid | sartorius |
| pectoralis major | adductor longus |
| latissimus dorsi | rectus |
| triceps | gracilis |
| biceps | tibialis anterior |
| brachioradialis | gastrocnemius |

5. The method of claim 4 wherein said striking step further comprises applying said glancing blows in an upward stroke.

6. The method of claim 5 further comprising the use of two of said exercise apparatus, one of said exercise apparatus being grasped by said user's hand and the other of said exercise apparatus being grasped by said user's other hand; said rotating and striking steps being simultaneously and alternately performed by the user's two hands.

7. A method of exercising using an elongated exercise apparatus having a cylindrical head cushion affixed to one end, and an annular heel cushion affixed to a second end with a handle being defined between the head and heel cushion, said method comprising:

grasping the heel cushion of the apparatus with one hand, and the head cushion of the apparatus with the other hand;

laying the exercise apparatus across a selected muscle group with the muscle group being contacted by the handle;

rolling the exercise apparatus over the muscle in a rolling pin motion while applying pressure to the muscle group thereby strengthening and toughening the muscle group.

8. The method of claim 7 wherein the muscle group is selected from the group consisting of:

| | |
|---|---|
| deltoid | gracilis |
| pectoralis major | vastus medialis |
| latissimus dorsi | tibialis anterior |
| gluteus medius | gastrocnemius |
| sartorius | soleus |
| adductor longus | abdominal muscles |

-continued

| |
|---|
| rectus |

9. The method of claim 8 wherein said rolling step is performed by rolling the exercise apparatus in the direction in which said muscle group extends.

10. A method of exercising using an elongated exercise apparatus having a cylindrical head cushion affixed to one end and an annular heel cushion affixed to a second end with a handle being defined between the head and heel cushion, said method comprising:

standing the apparatus on a selected muscle group with the heel cushion contacting the muscle group;

applying pressure longitudinally through the apparatus to the muscle;

twisting said exercise apparatus to create friction and heat upon the muscle group in order to strengthen and toughen the muscle group.

11. The method of claim 10 wherein said selected muscle group is selected from the group consisting of:

| | |
|---|---|
| trapezius | gluteus medius |
| deltoid | sartorius |
| pectoralis major | adductor longus |
| latissimus dorsi | rectus |
| triceps | gracilis |
| biceps | tibialis anterior |
| brachioradialis | gastrocnemius |

12. The method of claim 11 wherein the step of twisting is performed by alternately rotating the exercise apparatus in clockwise and then counterclockwise rotational motions.

13. A method of applying direct impact blows to a selected muscle group using an exercise apparatus having a head cushion affixed to one end and a heel cushion affixed to a second end with a handle being defined between the head and heel cushions, said method comprising:

grasping the exercise apparatus at the handle with the head cushion extending outwardly from the user's hand;

contacting said muscle group with a chopping motion applied substantially perpendicular to the surface of the muscle group; and repeating said contacting step until the desired level of conditioning is achieved but prior to causing bruising of the muscle group.

* * * * *